United States Patent [19]

Gay

[11] Patent Number: 4,893,761

[45] Date of Patent: Jan. 16, 1990

[54] AIR PRESSURE ACTIVATED COLLET

[75] Inventor: Benjamin A. Gay, Spartanburg, S.C.

[73] Assignee: Gay & Wagner Research Corporation, Spartanburg, S.C.

[21] Appl. No.: 175,207

[22] Filed: Mar. 30, 1988

[51] Int. Cl.[4] ..... B65H 54/54; B65H 75/30

[52] U.S. Cl. ..... 242/46.4; 242/72.1

[58] Field of Search ..... 242/46.4, 46.2, 46.3, 242/72, 72.1; 279/2 R, 2 A

[56] References Cited

U.S. PATENT DOCUMENTS

| | | | |
|---|---|---|---|
| 1,907,896 | 5/1933 | Summey | 242/72.1 X |
| 2,335,602 | 11/1943 | Nash et al. | 242/72 |
| 3,085,763 | 4/1963 | Floyd, Jr. | 242/72.1 |
| 3,128,958 | 4/1964 | Bongiovanni et al. | 242/72.1 |
| 3,489,363 | 1/1970 | Diolot | 242/72.1 |
| 3,614,007 | 10/1971 | Lenorak | 242/46.4 |
| 3,637,156 | 1/1972 | Shepherd | 242/72.1 |
| 3,977,616 | 8/1976 | Owens et al. | 242/46.4 |

FOREIGN PATENT DOCUMENTS

| | | | |
|---|---|---|---|
| 873891 | 8/1961 | United Kingdom | 242/72.1 |

*Primary Examiner*—Stanley N. Gilreath

*Attorney, Agent, or Firm*—Foley & Lardner

[57] ABSTRACT

A cylindrical collet is provided having moveable radial components which, when expanded, form a right angle cylinder capable of winding fibers. The components are moved between the expanded and compressed states, independent of the centrifugal force exerted by rotating collet. One technique of moving the components is by use of compressed air driving a piston coupled to the components.

6 Claims, 3 Drawing Sheets

AIR PRESSURE ACTIVATED COLLET

BACKGROUND OF THE INVENTION

When manufacturing continuous filaments, an apparatus often employed to wind the filaments is an expandable and contractable collet. One type of collet used for such purposes comprises a plurality of radially moveable fingers and wedges which, when expanded, form a smooth right cylinder surface for winding fibers. The collet when retracted allows the fibers to be easily removed. An example of such a collet is found in U.S. Pat. No. 3,871,592 issued to Kollenborn on Mar. 18, 1975. This collet is in its retracted state at rest or low rotating speeds, but due to centrifugal force at higher rotating speeds the wedges and fingers move radially outward and form a smooth cylindrical surface to be used in winding the fibers.

The prior art, however, as embodied in U.S. Pat. No. 3,871,592 does not provide for the positive motion of the wedges and fingers into the expanded and retracted positions. It is often desireable to select when the collet is in a particular state independent of the rotational speed of the collet itself, a function not found in prior art collets.

SUMMARY OF THE PRESENT INVENTION

In accordance with the present invention, a collet, having a plurality of radially moveable wedge and finger elements which form a smooth cylindrical winding surface in an expanded state is provided with a positive and selective drive, independent of the rotational speed of the collet, for urging the wedge and finger elements into the expanded state and returning them to the retracted state when desired. The finger and wedge elements are configured such that movement of one is in response to the movement of the other. Moveable guides generally constrained to move axially are coupled to one of the wedge and finger elements and provide radial movement thereto. The guides are associated with a generating force which provides predetermined axial motion to the guides thereby causing the radial movement of the finger and wedge elements.

BRIEF DESCRIPTION OF THE DRAWINGS

A preferred exemplary embodiment of the present invention will hereinafter be described wherein like numerals denote like elements and.

DETAILED DESCRIPTION OF THE PREFERRED EMBODIMENT

Figure 1:
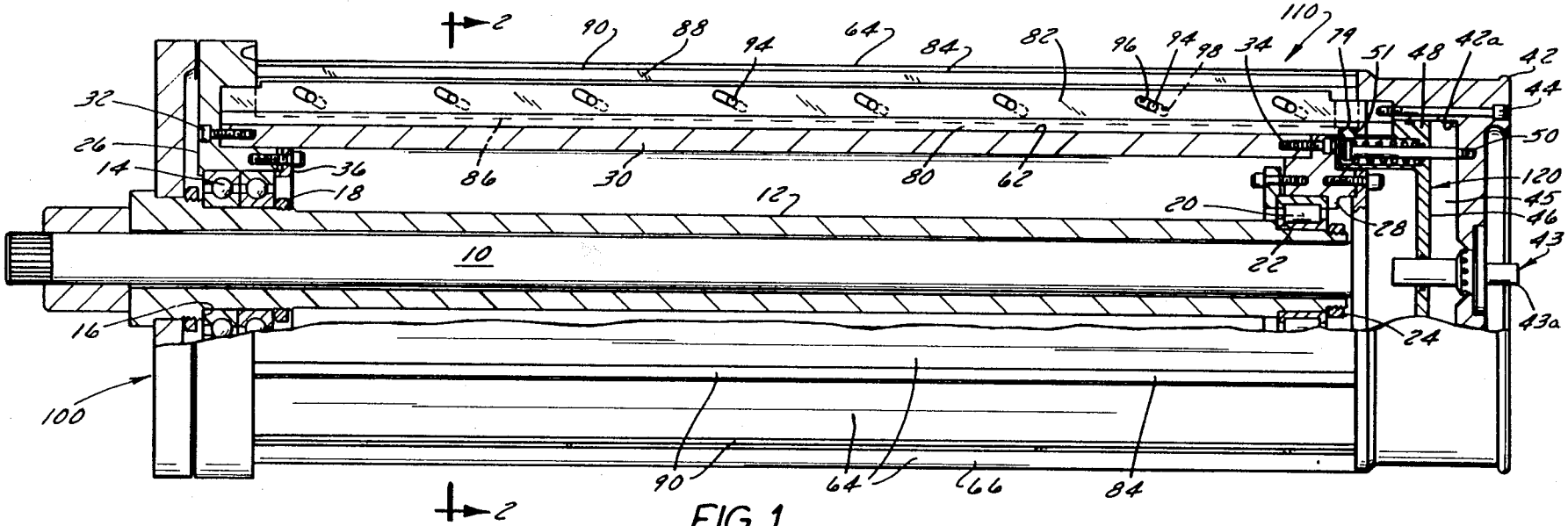
FIG. 1 is a side sectional view of a collet in accordance with the present invention.

As is best seen in FIG. 1, the collet of the present invention may be considered as comprising four major components: a stationary shaft 10 and associated elements; a hub assembly 100; a housing assembly 110 and a piston assembly 120. Briefly, shaft 10 and associated elements are those elements which interact with and permit hub assembly 100 to rotate about shaft 10. Hub assembly 100 comprises, in part, hub members 26 and 28 and associated elements which rotate about shaft 10. Housing assembly 110 is keyed to hub assembly 100 and generally comprises those elements such as housing member 30, fingers 64 and wedges 84 (best illustrated in FIGS. 2 and 3) which form the surface of the collet, and guide members 78 which couple with piston assembly 120. Piston assembly 120 comprises the various elements including piston 46 which translates air pressure introduced into piston assembly 120 and the evacuation thereof into movement of the various elements of housing assembly 110.

Referring to FIG. 1, it may be seen that shaft 10 has a mandrel 12 mounted thereon. Near the left end of the mandrel 12 is mounted a duplex bearing 14 secured against shoulder 16 of mandrel 12 by a locknut 18. A cylindrical roller bearing 20 is mounted about the right end of mandrel 12 and secured against axial movement between shoulder 22 and locknut 24. Bearing 14 functions to rotatably support one end of hub assembly 100 via annular rear hub member 26 while cylindrical bearing 20 serves the identical function with respect to annular front hub member 28.

Annular housing member 30 is bolted to rear hub member 26 by a plurality of bolts 32 and to front hub member 28 by bolts 34. The annular clamp rings 36 and 38 clamped respectively to hubs 26 and 28 serve to ensure against relative axial movement between hubs 26, 28 and bearings 14, 20. An end cap 42 is tightly bolted to the right end of housing 30 by bolts 44 and is provided with an air valve 43. The cavity formed by end cap 42 serves as cylinder 45 for piston 46 having a circular head 48 whose outer periphery thereto guides along the interior surface 43 of end cap 42. An O-ring 47 is positioned within a circumferential groove in piston head 48.

Extending axially from piston head 48 is an annular piston shaft 49 with walls appropriately bored with bores 49*a* to receive a plurality of shoulder bolts 50, about which are mounted compression springs 52. Piston shaft 49 is provided with a small circumferentially extending rib 51 for a purpose to be described. Compression springs 52 are held between counterbore shoulders 53 at one end and the head of shoulder bolts 50 at the other. An O-ring 55 is positioned around the shaft 49 to provide an air tight seal. Shoulder bolts extend through the small diameter portion of bores 49*a* to end cap 42. Thus, piston 46 although spring biased towards end cap 42 can move along bolts 50 when a countering force due to increased air compression within cylinder 45 is experienced by piston head 48.

Figure 1B:
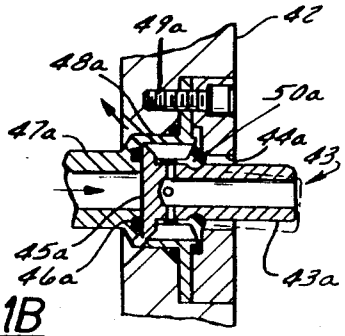
FIG. 1*b* is a side sectional view of a portion of air cylinder, valve and associated components.

Reference is made to FIG. 1*b* which more clearly shows the relationship of air valve 43 and cylinder 45. Air valve 43 comprises a stem 43*a* mounted within a bore 44a and secured to valve head 45*a*. Head 45*a* abuts in an air tight relationship resilient O-ring 46*a* mounted in and around the mouth of air channel pipe 47*a* leading to cylinder 45. Pipe 47*a* is provided with an annular flange 48*a* which defines bore 44a and is secured to end cap 42 by bolts 49*a*. A second resilient O-ring 50*a* mounted in flange 48*a* abuts valve head 45*a* on the opposite side thereof. Pressure is introduced into the collet valve 43 through stem 43*a* by use of a flexible hose (not shown) leading from an outside source of compressed air. The technique is identical to the well known process of inflating an automobile tire in that such flexible hoses have a force-opening check valve and a nozzle mating with stem 43*a*. An operator presses a hose connected to a source of compressed air, rocking valve 43 to one side as shown by the dotted lines and compressed air flows into the valve 43. O-ring 50*a* is then compressed, and allowing compressed air to fill cylinder 45 which results in the collapse of the collet as described in more detail below. When it is desired to evacuate cylinder 45, stem 43*a* is again rocked to the dotted line position, causing head 45*a* to compress against O-ring 50*a* and allowing compressed air to exit cylinder 45 as desired. While valve 43 as shown works satisfactorily, it should be understood that other valve mechanisms compatible with the function of the collet of the present invention could be employed as well.

Figure 1A:
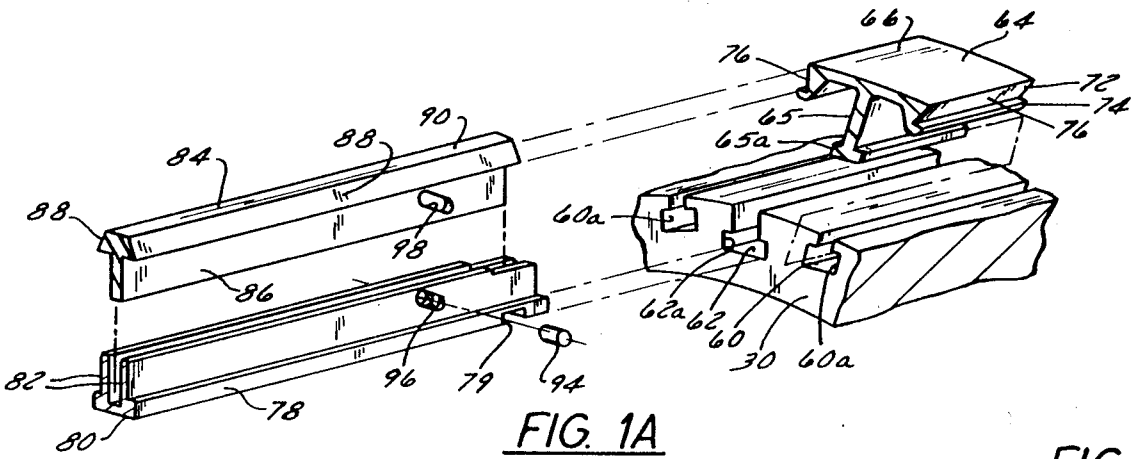
FIG. 1*a* is an exploded perspective view depicting the spatial relationship of the fingers, wedges and guides of the collet in accordance with the present invention.
Figure 2:
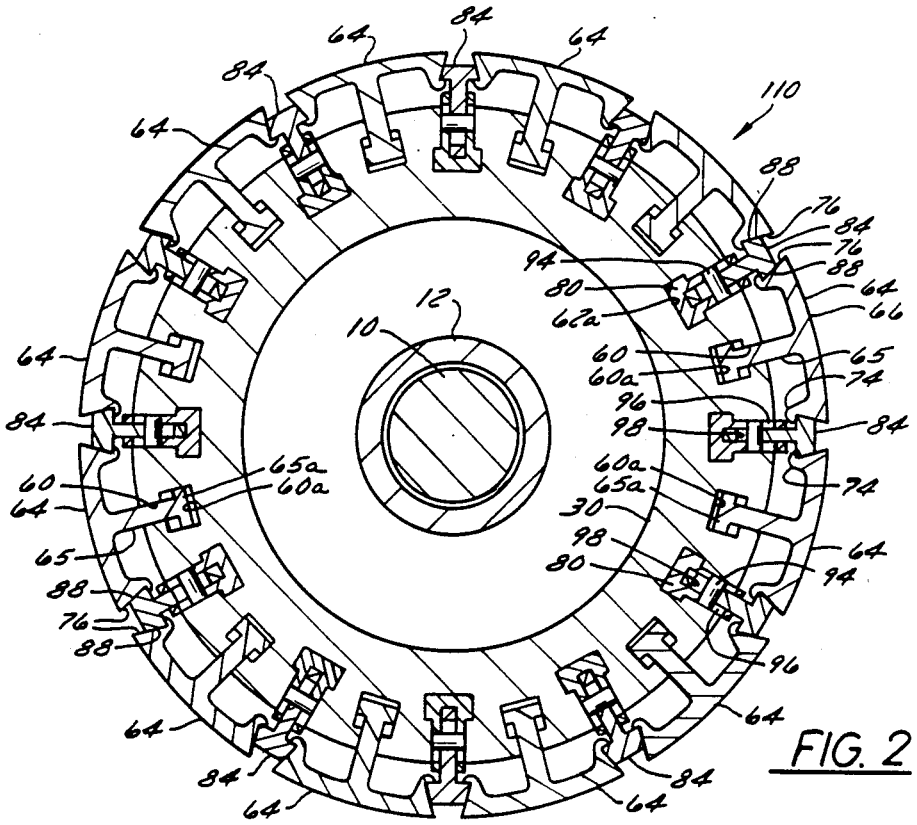
FIG. 2 is an axial sectional view taken along lines 2—2 of FIG. 1 in which the collet configuration is in a compressed configuration.
Figure 3:
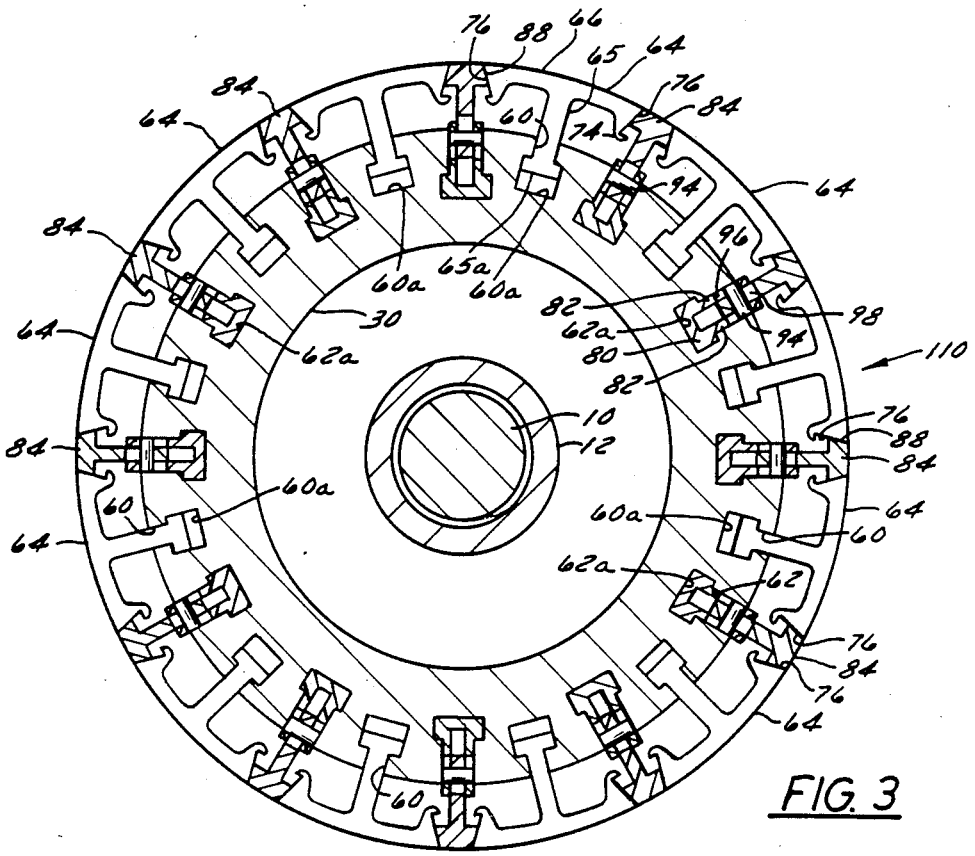
FIG. 3 is an axial sectional view similar to FIG. 2 in which the collet is in an expanded configuration.

As best viewed in FIGS. 1*a*, 2 and 3, housing member 30 is provided with a plurality of channels 60 and 62 aligned parallel to the longitudinal axis of housing member 30 and alternately positioned with respect to each other. Positioned within each channel 60 is a finger 64 which, in the side sectional views of FIGS. 2 and 3, has a T-shaped section with a downward extending stem 65 ending in an enlarged portion called foot 65*a*. Finger 64 is mounted to slide within its respective channel 60 in a radial direction with respect to the longitudinal axis of member 30. Channel 60 is provided with an enlarged portion 60*a* geometrically complimentary to and enclosing foot 65*a*. Radial movement of finger 64 is permitted but restricted by the cooperation between channel portion 60*a* and foot 65*a*. Axial movement of finger 64, i.e. movement in the direction of the axis of shaft 10, is prevented by the abutment of the ends of fingers 64 with hub member 26 and end cap 42. The top surfaces 66 of fingers 64 are slightly curved toward arms 72 thereof which generally extend in the same direction as stems 65 and terminate at shoulders 74. Each arm 72 further provides a side engaging surface 76 which diverges outwardly from the radial center line of their respective fingers 64.

Channels 62, like channels 60, have an enlarged bottom portion 62*a* and houses axially moveable guides 78 having a complimentary configuration including an enlarged base 80 and a pair of spaced arms 82. Base 80 by virtue of its tight complimentary fit within enlarged portion 62*a* of channel 62 prevents radial movement of guide 78 but permits axial movement. Wedges 84 located between each finger 64 has a stem 86 positioned between arms 82 of guide 78. Axial movement of wedges 84 is restricted due to the abutment of each end thereof against hub member 26 and end cap 42. Each wedge 84 is coupled to its respective guide 78 through the interaction of a roller 94 mounted in slots 96 and 98 respectively formed in the spaced arms 82 of respective guide 78 and slot 98 in the stem 86. Roller 94 rotates fully within slot and is axially constrained by the abutment of its end thereof against adjacent interior surfaces of housing 30.

Wedges 84 have side surfaces 88 which diverge outwardly from the radial center line thereof and are complimentary to and abut finger side surfaces 76. The top or outer surface 90 of wedge 84 is slightly curved toward side surfaces 88 such that, when fingers 64 and wedges 84 move radially outward to the fullest extent possible, the respective top surfaces 66 and 90 form a smooth continuous cylindrical surface.

Referring again to FIG. 4*a*, it may be seen on the right hand side that each guide 78 has a notch 79 which fits over rib 51 on piston shaft 49. Coupling of each guide 78 to piston 46 provides the axial movement to guide 78 as piston 46 moves and the consequential radial movement of wedges 84 and fingers 64.

Figure 4A:
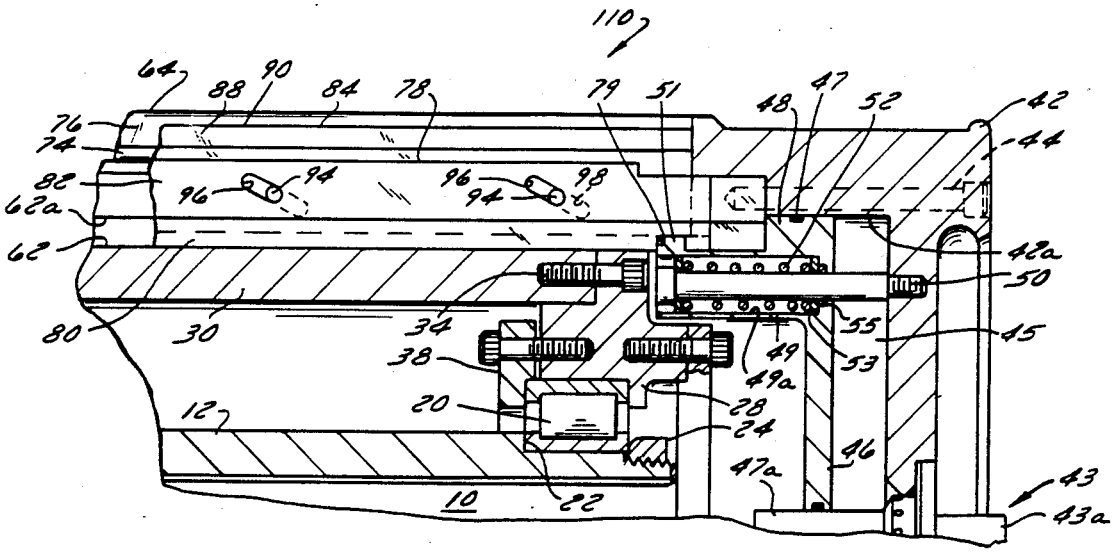
FIGS. 4A–4D are partial sectional views illustrating the coupling relationship between the guide and wedges operative sequence.
Figure 4B:
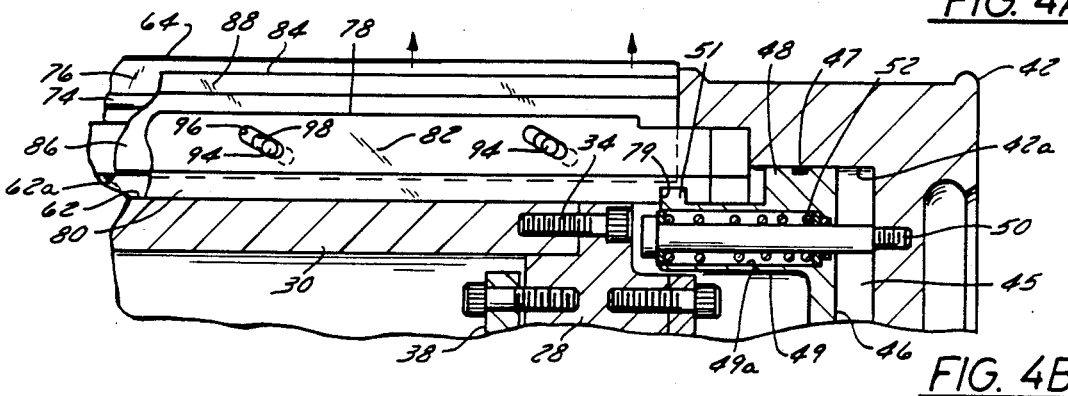
Figure 4C:
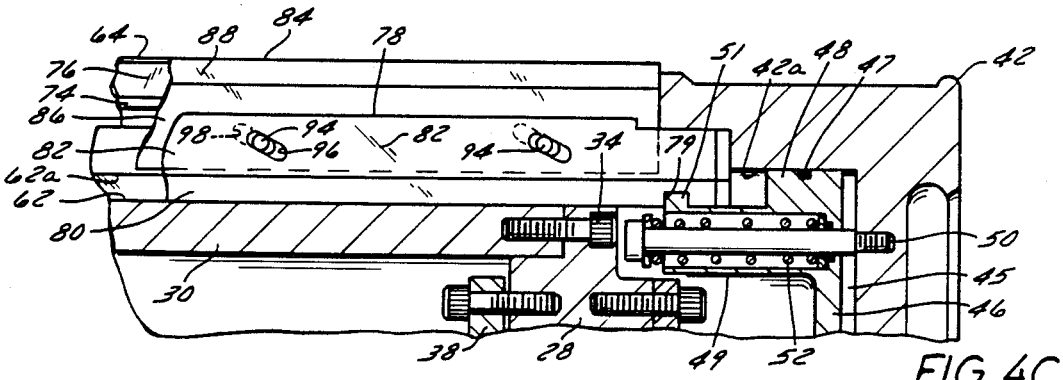
Figure 4D:
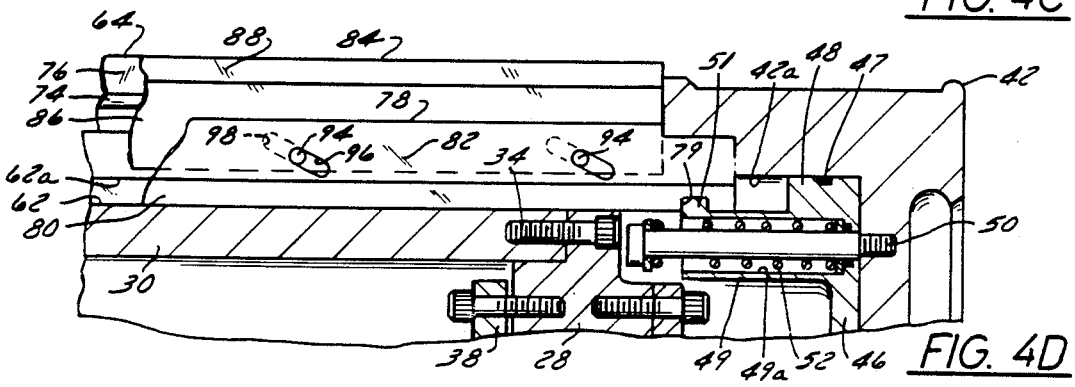

To best understand the operative sequence of the present invention, reference is made to FIGS. 4A–4D in which piston 46 is being moved from left to right, i.e. in the direction of end cap 42, by springs 50. In the operation sequence portrayed by FIG. 4A, the air pressure within cylinder 45 formed by end cap 42 has caused piston 46 to be positioned as far to the left of end cap 42 as possible. In this position, collet 10 is in its contracted state. As the air pressure within cylinder 45 is reduced, piston 46 is urged to the right by springs 52. Guides 78 must follow due to the coupling interaction therebetween. The axial movement of guides 78 with respective guide slots 96 cause each roller 94 mounted therein to rotate up the surface of its respective slot 96, bearing against the upper surface of slot 98 of respective wedge 84. Wedge 84 constrained for radially movement only then moves radially upward as depicted by vertical arrows in FIG. 4B. Wedge side surfaces 88 then engage finger side surfaces 76 causing upward radial movement of fingers 64 also. When piston 46 ceases further movement, and is positioned as illustrated in FIG. 4D, the collet is in its fully expanded condition (per FIG. 3).

The provision of paired slots 94, 96 and roller 94 to provide for the range of desired mechanical motions is preferred, but other mechanical coupling arrangements may be employed as required. For example, arms 82 may be provided with a cylindrical cam member extending between the arms and through slot 98 in each wedge. As guide 78 moves, slot 98 follows the cylindrical cam and moves its respective wedge 84 in a radial direction. It is important, however, to insure that radial motion of wedges (and fingers) is coordinated with the axial movement of guides. In the preferred paired slot arrangement, it has been found that a specified axial movement of the guides should cause the same vertical movementin the fingers. Thus, a 45° slot angle is preferred although depending upon the precise application other angles may be emphasized. Adjustment of the slot angle changes the magnitude of relative movement between the guide and fingers.

To reverse the sequence of operation toward an expanded state the air cylinder 45 is charged with an appropriate air pressure through valve 43 to overcome the resistance of springs 52. Initially, the condition of the collet is as is shown in FIG. 4D with the piston head 48 adjacent to the interior surface of end cap 42. When air is charged in cylinder 45, piston 46 moves to the left, compressing springs 52 and engaging guide 78. The coupling interaction between guide 78 and respective wedge 84 causes wedge 84 to move radially inward whereupon the outer periphery of the lower edge of wedge side surfaces 88 make abutting contact with shoulder 74 of adjacent fingers 64. Continued inward movement of wedge 84 causes similar movement of finger 64 until the respective side engaging surfaces 76 and 88 make contact as shown in FIG. 2. Further, inward movement is prevented. The sequence is thus complete with the collet 10 being returned to its contracted state as shown in FIG. 4A.

It will be understood that the foregoing description is of a preferred embodiment of the present invention and is not limited to the specific forms shown. Modification may be made in the design and arrangement of the element within the scope of the present invention as expressed in the appended claims.

I claim:

1. A collet for use in winding continuous filaments comprising:

(a) a shaft with a central axis;

(b) a hub assembly rotatably mounted on said shaft;

(c) a housing assembly associated with said hub assembly for rotation therewith, said housing assembly including:

(i) a plurality of finger means and wedge means mounted for movement substantially along radial lines emanating from said central axis between respective retracted positions and expanded positions;

(ii) said finger and wedge means each having heads with curved outer surfaces collectively forming a substantially continuous surface when in said respective expanded positions, each of said finger means having a shoulder extending from a terminal end of each side and said head of each wedge means engaging said shoulder of adjacent finger means when said wedge means are moved inwardly to move said finger means to said retracted position, said finger means coupled to said wedge means and moving to said expanded position in response to outward movement of said wedge means; and (d) means for moving said wedge means between said respective expanded and retracted positions.

2. The collet according to claim 1 in which said wedge and finger means each have side surfaces, said wedge means side surfaces abutting said finger means side surfaces of adjacent finger means in both said respective expanded and retracted positions.

3. The collet according to claim 1 in which each of said wedge means has a central stem extending inward from said head thereof, said housing assembly including a plurality of channels each adapted to receive one of said stems, said moving means including guide means positioned in said channels for restricting said wedge means to radial movement.

4. The collet according to claim 1 in which said moving means includes pressure actuated means for moving said wedges and fingers from said one radial position radially inward to a second radial position.

5. The collet according to claim 4 in which said pressure actuated means includes a piston and cylinder, said cylinder having valve means for charging and discharging air pressure within said cylinder.

6. The collet according to claim 5 in which said pressure actuated means includes a plurality of springs urging said piston in a first direction and yieldable to movement of said piston in a second direction.

* * * * *